US005266062A

United States Patent [19]

Runckel

[11] Patent Number: 5,266,062

[45] Date of Patent: Nov. 30, 1993

[54] AMPHIBIOUS FOOTWEAR

[75] Inventor: John L. Runckel, Lake Oswego, Oreg.

[73] Assignee: John L. Runckel Trust, Portland, Oreg. ; John L. Runckel and Markie W. Runckel, cotrustees

[21] Appl. No.: 921,556

[22] Filed: Jul. 28, 1992

[51] Int. Cl.[5] ..... A63B 31/00

[52] U.S. Cl. ..... 441/64; 36/8.1; D21/236

[58] Field of Search ..... 441/55, 56, 61–65, 441/75; 36/8.1, 113, 116; D21/236–239

[56] References Cited

U.S. PATENT DOCUMENTS

| | | | |
|---|---|---|---|
| Re. 23,006 | 6/1948 | Churchill et al. | 36/8.1 |
| 1,074,595 | 10/1913 | Aumont | 441/64 |
| 1,571,462 | 2/1926 | Waldron et al. | 441/64 |
| 1,793,937 | 2/1931 | Knudsen | 441/64 |
| 2,099,973 | 11/1937 | De Corlieu | 441/64 |
| 2,179,124 | 11/1939 | Jesnig | 441/64 |
| 2,321,009 | 6/1943 | Churchill et al. | 36/8.1 |
| 2,332,252 | 10/1943 | Payne | 441/64 |
| 2,343,468 | 3/1944 | Messinger | 441/64 |
| 2,541,738 | 2/1951 | Bassichis | 441/64 |
| 2,588,363 | 3/1952 | De Corlieu | 441/64 |
| 2,672,629 | 3/1954 | La Trell | 441/64 |
| 2,865,033 | 12/1958 | Jayet | 441/64 |
| 2,889,563 | 6/1959 | Lamb et al. | 441/64 |
| 2,903,716 | 9/1959 | Zasada | 441/1 |
| 2,903,719 | 9/1959 | Wozencraft | 441/64 |
| 2,950,487 | 8/1960 | Woods | 441/64 |
| 2,954,617 | 10/1960 | Yamaguchi | 36/8.1 |
| 3,042,943 | 7/1962 | Katehis | 441/64 |
| 3,107,372 | 10/1963 | Brown et al. | 36/8.1 |
| 3,112,503 | 12/1963 | Girden | 441/64 |
| 3,178,738 | 4/1965 | La Trell | 441/64 |
| 3,239,857 | 3/1966 | Gwynne | 441/64 |
| 3,302,222 | 2/1967 | Ferraro | 441/64 |
| 3,605,292 | 9/1971 | Goldblatt | 36/8.1 |
| 3,640,006 | 2/1972 | Kendrick | 36/8.1 |
| 3,676,940 | 7/1972 | Shively | 36/8.1 |
| 3,683,519 | 8/1972 | Creamer | 36/11.5 |
| 3,922,741 | 12/1975 | Semeia | 441/64 |
| 3,936,896 | 2/1976 | Creamer | 36/11.5 |
| 3,952,351 | 4/1976 | Gisbert | 441/64 |
| 4,083,071 | 4/1978 | Forjot | 441/64 |
| 4,322,894 | 4/1982 | Dykes | 36/8.1 |
| 4,495,715 | 1/1985 | Fredrickson et al. | 36/113 |
| 4,521,220 | 6/1985 | Schoffs | 441/64 |
| 4,627,820 | 12/1986 | Penebre | 441/64 |
| 4,645,466 | 2/1987 | Ellis | 441/74 |
| 4,689,029 | 8/1987 | Ciccotelli | 441/64 |
| 4,775,345 | 10/1988 | Gifford | 441/75 |
| 4,778,423 | 10/1988 | Ciccotelli | 441/64 |
| 4,787,871 | 11/1988 | Tomlinson | 441/64 |
| 4,857,024 | 8/1989 | Evans | 441/64 |
| 4,889,510 | 12/1989 | Piatt | 441/62 |
| 4,940,437 | 7/1990 | Piatt | 441/64 |
| 4,948,385 | 8/1990 | Hall | 441/64 |
| 4,952,183 | 8/1990 | Gil | 441/64 |
| 4,954,111 | 9/1990 | Cressi | 441/64 |
| 4,954,112 | 9/1990 | Negrini et al. | 441/64 |
| 4,973,049 | 11/1990 | Ciolino | 272/116 |
| 5,041,039 | 8/1991 | Chang | 441/64 |
| 5,108,328 | 4/1992 | Hull | 441/64 |
| 5,139,450 | 8/1992 | Steele | 441/64 |

FOREIGN PATENT DOCUMENTS

| | | |
|---|---|---|
| 0436927 | 7/1991 | European Pat. Off. . |
| 1172572 | 8/1985 | U.S.S.R. . |

OTHER PUBLICATIONS

*Swimming World*, vol. 26, No. 4, Apr. 1985, pp. 37–40.

"Speedo" 1991 Catalog, p. 36.

*Primary Examiner*—Robert J. Oberleitner

*Assistant Examiner*—Clifford T. Bartz

*Attorney, Agent, or Firm*—Kolisch, Hartwell, Dickinson, McCormack & Heuser

[57] ABSTRACT

Footwear which is versatilely useful for both land and water sports is described along with a method of production. A stretchable fabric vamp is conformable around the upper arch region of a user's foot. The vamp is joined to an upper edge of an elastomeric base piece including sole and fin portions. The flexibility of the vamp provides comfort and versatility for various walking, running, surfing or swimming activities. The base piece is more rigid than the vamp. The fin is stabilized by a toe support which contains the user's toes and is part of the same unitary base piece. The rigidity of the base piece provides hardness for the sole to protect the foot from harsh ground conditions and stiffness for the fin producing desirable water resistance qualities for enhancing swim power.

16 Claims, 2 Drawing Sheets

AMPHIBIOUS FOOTWEAR

BACKGROUND OF THE INVENTION

The present invention relates to footwear. In particular, the invention involves a versatile amphibious shoe which is useful for swimming and surfing as well as standing or walking.

For many years swim fins have been used by swimmers to increase swimming power and speed. The typical swim fin includes a rubber shoe and a forwardly extending widened blade for maximizing surface area and water resistance during water kicking activities. A principal problem with the common swim fin is that the blade hinders the user's walking motion once the user gets out of the water. Thus, it is often necessary for the user to remove the swim fin before exiting the water. However, some sports such as surfing, water aerobics and water polo require frequent and rapid movement between swimming and standing activities. In these sports there is no time to take fins on and off or to make adjustments without interrupting the continuity of the activity. Therefore, use of conventional swim fins for such sports has been practically precluded.

For example, ocean and wind surfers have a need for swim fins to increase kicking and swimming power while in the water. However, it is not convenient for them to use conventional swim fins because they interfere with the surfer's ability to frequently and agilely move in and out of the water and the surfer does not usually have time to remove the fins before mounting the surf board.

Prior inventors have recognize the need for amphibious footwear. For example, U.S. Pat. No. 2,903,719 and U.S. Pat. No. 5,041,039 disclose shoes with removable fins. Such footwear is cumbersome and impractical for the following reasons. First, the user often does not have time to attach or detach a fin to the shoe as he moves between land and water. Second, the fin components must be carried or dragged around when they are not being used. Thus, prior amphibious swim-shoe designs are not satisfactory for activities where the user has to rapidly move back and forth between water and land activities.

Another problem with prior swim fins, such as the one disclosed in U.S. Pat. No. 2,903,719 is that the shoe component of the fin tends to collect sand or other matter causing discomfort. This problem is particularly pronounced in swim fins which are cut relatively low on the sides and are open over the upper arch area of the user's foot. The problem is also particularly prevalent when the fins are worn around sandy areas such as beaches.

Others have produced footwear which can be worn versatilely in and out of water but which fail to enhance the swimmer's kicking power. Such aquatic shoe or "aqua sock" type footwear typically consists of a foot-shaped sock component supported by a rubber sole. While aqua socks can be worn in and out of water, they have no fin or other mechanism for allowing a swimmer to increase kicking power. Moreover, the sole on a typical aqua sock is not sufficiently rigid to adequately support or stabilize a fin blade during swimming.

Thus, an objective of the present invention is to provide a comfortable amphibious swim-shoe which is useful for increasing kicking power, yet can be worn versatilely on land and in water.

Another objective of the invention is to provide amphibious footwear which can be comfortably worn for walking on land without manipulating or removing a component of the footwear.

Another objective of the invention is to produce a swim-shoe which is not susceptible to picking up sand or other debris which is typically present around beaches.

SUMMARY OF THE INVENTION

The problems discussed above and other problems with the prior art are solved by the present invention which involves an amphibious swim-shoe including a stretchable fabric vamp which is conformable around the upper arch region of a user's foot. The vamp is joined to an upper circuitous edge of an elastomeric base piece including a sole and a forwardly extending fin. The fin is preferably limited in its dimensions so that the user's walking motion is not significantly hindered.

In a preferred embodiment, the swim-shoe is approximately ankle-high and totally encloses the user's foot. The vamp is made of an isotropically stretchable fabric which maintains its resiliency in and out of water. A base piece is integrally associated with the vamp and includes a sole and a forwardly extending fin. The base piece is made of an elastomeric material which is stiffer and more rigid than the sock material, thus protecting the foot from the ground on land and also being capable of exhibiting optimal water resistance qualities for kicking and swimming activities.

A method for producing the amphibious footwear involves producing a vamp out of a stretchable fabric, followed by molding an elastomeric base piece including a sole and a fin around the vamp and joining a circuitous upper edge of the base piece to the vamp.

DETAILED DESCRIPTION OF THE PREFERRED EMBODIMENTS

The present invention provides amphibious footwear including a swim fin component which is large enough to significantly enhance a swimmer's kicking power but small enough to allow substantially unhindered walking. The versatile qualities of the footwear are further enhanced by combining an isotropically stretchable upper vamp with a relatively rigid elastomeric base piece including a sole and a fin. The stretchable vamp provides comfort and permits ankle flexing during walking and/or running activities on land. The foot-conformable vamp, in combination with the base piece, totally encloses the user's foot so that access by which sand or other debris may enter the footwear is minimized. The relatively rigid sole is integrally connected to the fin component via a reinforced fin support member extending over the user's toes. The sole supports and protects the foot from harsh ground conditions such as hot sand or rocky terrain. The stiffness of the rubber fin component provides optimal water resistance capability for swimming activities.

Figure 1:
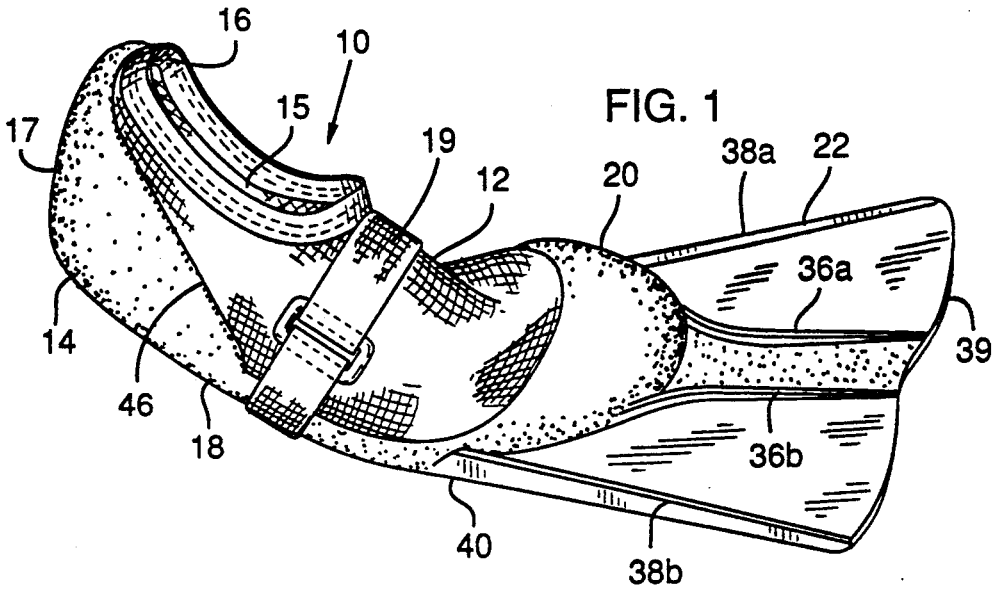
FIG. 1 is a perspective view of an amphibious swim-shoe in a preferred embodiment of the present invention.
Figure 2:
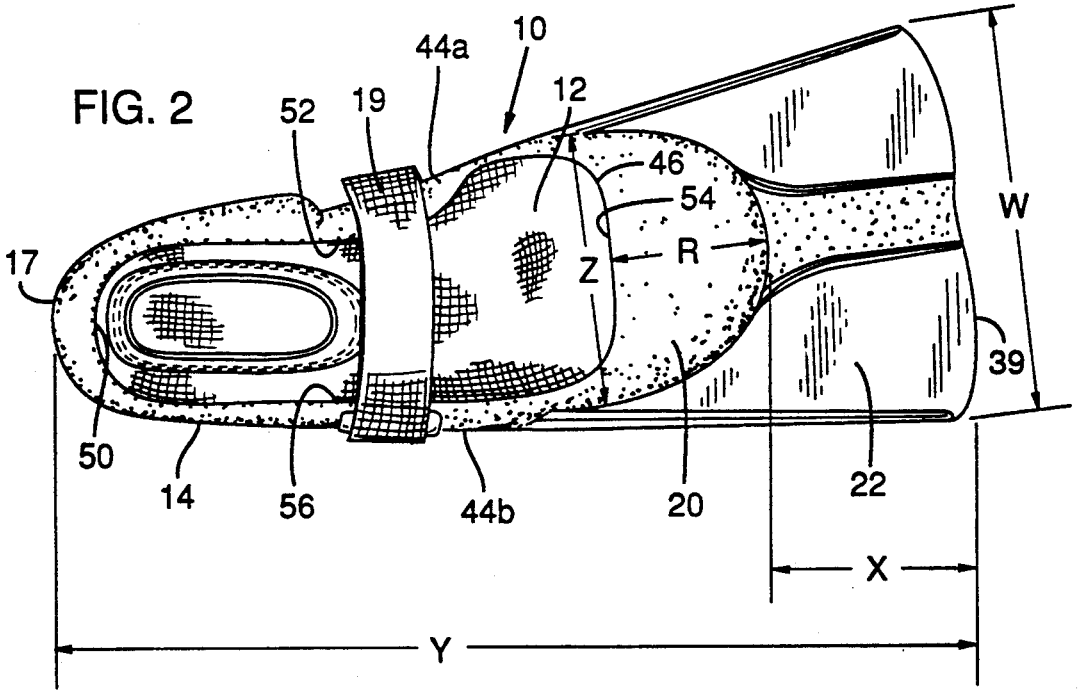
FIG. 2 is a top view of the amphibious swim-shoe shown in FIG. 1.
Figure 4:
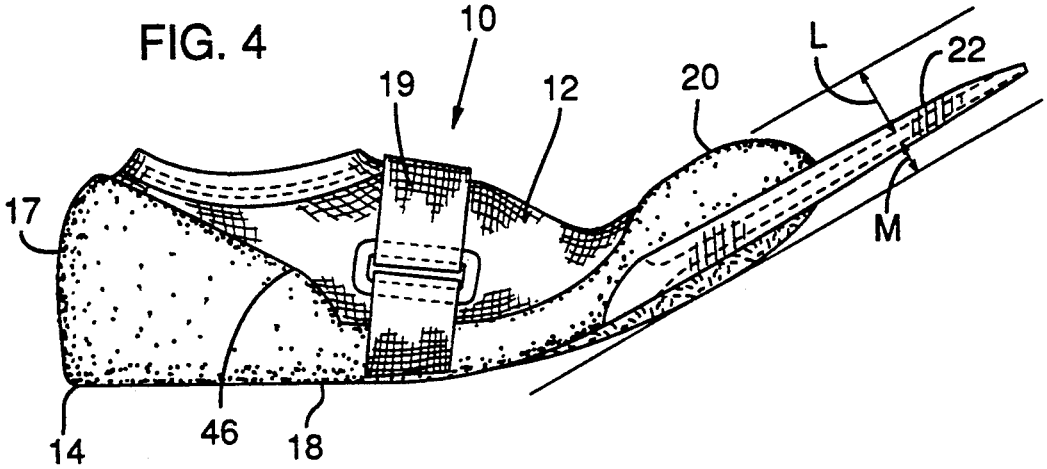
FIG. 4 is a side view of the amphibious swim-shoe shown in FIG. 1.
Figure 5:
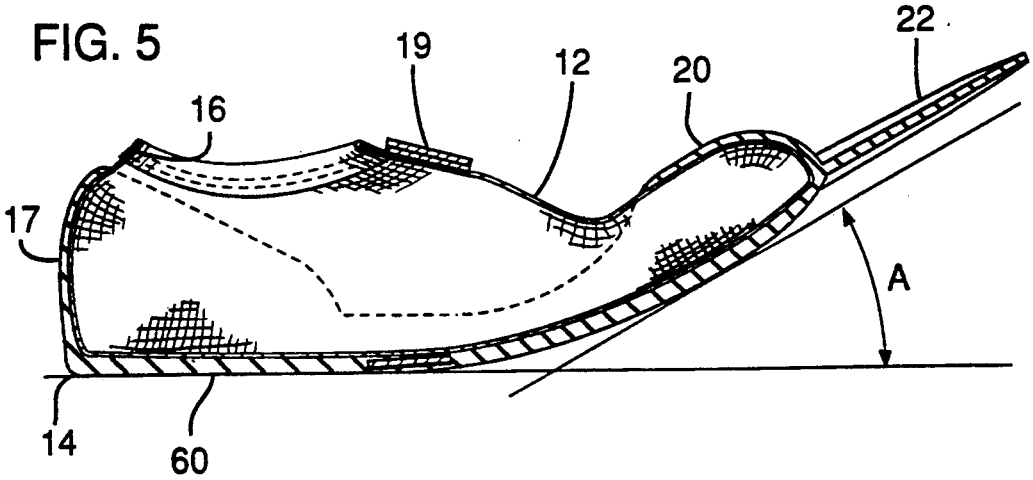
FIG. 5 is a sectional view of the amphibious swim-shoe shown in FIG. 1.

FIG. 1 shows a swim-shoe 10 in a preferred embodiment of the present invention in which a stretchable "vamp" or "upper member" 12 is circuitously joined to an elastomeric base piece 14. The vamp 12 should be made of a material which "water compatible", meaning that it should maintain its stretch and resilience characteristics equally well in and out of water. The vamp is preferably ankle-high and has an opening 15 through which the user can insert a foot. A rim or band 16 can be sewn around the vamp opening 15 to provide reinforcement and an additional aesthetic quality. The vamp 12 is made of a stretchable fabric which is conformable around the upper arch portion of the user's foot. Preferably, the vamp material is isotropically stretchable, i.e., stretchable along all axes in the plane of the fabric. As shown in FIGS. 1, 2 and 4, the vamp actually covers the majority of the upper surface of the user's foot. The vamp 12 completely surrounds the user's ankle and, in combination with the elastomeric base piece 14, totally encloses the user's foot, thereby minimizing entry of sand or dirt into the swim-shoe.

Optionally, a releasable strap 19 is useful for providing support over a midsection of the stretchable vamp. The strap 19 is particularly helpful while swimming, but is releasable, for example by velcro, to allow ease of movement during other activities.

The base piece 14 includes a reinforced heel support member 17 attached to a sole 18. A fin support member 20 is formed in the base piece 14 near the forward tip of the sole 18. The fin support member 20 extends over the top of the user's toes and functions as a stabilizing anchor for the fin 22 which extends forwardly from the sole 18. As shown in FIG. 4, the plane of the fin 22 is elevated from the plane of the forward portion of the sole 18. It has been discovered that elevation of the fin relative to the sole provides significantly greater comfort and usefulness for standing, walking, or pushing off from a swimming pool wall. The elevated fin feature allows the user to "feel" the ground or swimming pool wall without significant interference from the fin. In the preferred embodiment the distance, M in FIG. 4, from the fin's under-surface to the plane $P_1$ which is tangent to the sole's under-surface is approximately 50% of the distance L from the fin's top surface to the plane $P_2$ which is tangent to the top of the fin support 20. For example, the distance M is in the range of ¼ to 1 inch.

It is important that the fin 22 be sufficiently stiff so that its forwardly extending form is substantially maintained during water kicking activities. In a preferred embodiment of the present invention the desired fin stiffness is accomplished by a combination of features. First, a relatively rigid base piece material is selected, preferably a rubber/polymer mixture which is more rigid than a conventional aqua sock sole. Second, a reinforced fin support member 20 is molded into the base piece 14. The fin support extends over the user's toes and provides important stability for the fin 22. In a preferred embodiment the length, R in FIG. 2, of the toe support 20 is approximately 60% to 70% of the length X of the fin 22. For example, preferably the length R is in the range of ½ to 3 inches. With the fin illustrated in FIG. 2 which has a length Y of 14 inches, a blade length X of 2¾ inches, the length R is approximately 1¾ inches. Third, the fin 22 may include one or a plurality of central support ribs 36*a* and 36*b* positioned intermediately between the fin's lateral edges 38*a* and 38*b* and extending perpendicularly from the fin's distal edge 39 to the fin support 18. The support ribs 36*a* and 36*b* may be dimensionally varied for the purpose of providing optimal water resistance while swimming.

FIG. 2 shows a top view of the swim-shoe depicted in FIG. 1. The swim-shoe is made primarily of two materials, the stretchable and conformable fabric vamp 12 and the elastomeric base piece 14. The base piece 14 is made of a relatively stiff rubber material and, as shown in FIG. 2, includes a heel support 17, lateral edges 44*a* and 44*b* of the sole 18, fin support member 20 and fin 22. Experimental trials have shown that the above-described combination of a conformable vamp 12 integrally supported within a relatively stiffer base piece 14 including sole and fin components produces exceptionally versatile footwear which can be advantageously worn for a large variety of different sporting activities.

Importantly, the vamp 12 is securely attached to the base piece 14 along a circuitous joinder line 46 which surrounds the user's ankle and extends from an upper edge 50 of the heel support 17, to an inner medial edge 52 of the sole 18, to an inner edge 54 of the fin support member 20, to an outer medial edge 56 of the sole 18, back to the heel support. The illustrated vamp design has been found to provide a particularly advantageous balance between comfort and function. However, other vamp designs which conformably cover the upper arch portion of the user's foot may be used.

A goal of the present invention is to maximize the surface area of the fin within limits which allows substantially unhindered standing or walking. In a preferred embodiment, the fin 22 has a maximum width near its distal edge 39, then tapers inward to a minimum width at the points 40 where the edges 38*a* and 38*b* of the fin 22 merge with the sole 18 of the base piece 14. This tapered profile provides an optimal balance between swimming and walking functionabilities and allows the swimmer to feel the fin movement and coordinate the kicking movement to produce optimal propulsion.

FIG. 2 also demonstrates some important dimensional aspects of the present invention. As mentioned briefly above, in order to maintain the walkability characteristic of the footwear, it is necessary to limit the size of the fin 22 relative to the entire amphibious swim-shoe. In a preferred embodiment, the fin 22 extends beyond the fin support member 20 by a length X which is less than 25 percent, preferably about 20 percent, of the total length Y of the swim-shoe. For example, in a swim-shoe having a total length Y of 14 inches, the fin length X would be approximately 2¾ inches. Experiments have shown that by limiting the size of the fin 20 within this interval, optimal versatility of the footwear for land and water use is permitted. The width of the fin 22 should also be limited in accordance with the dimensions illustrated in FIG. 2. The maximum width W of the fin 22 at its distal edge 39 should be limited to approximately 130% of the maximum width Z of the sole 18 in order to avoid walking hindrance. For example, a preferable maximum fin width W is in the range of 3 to 6 inches, and the maximum width Z of the sole is in the range of 2½ to 4½ inches.

Figure 3:
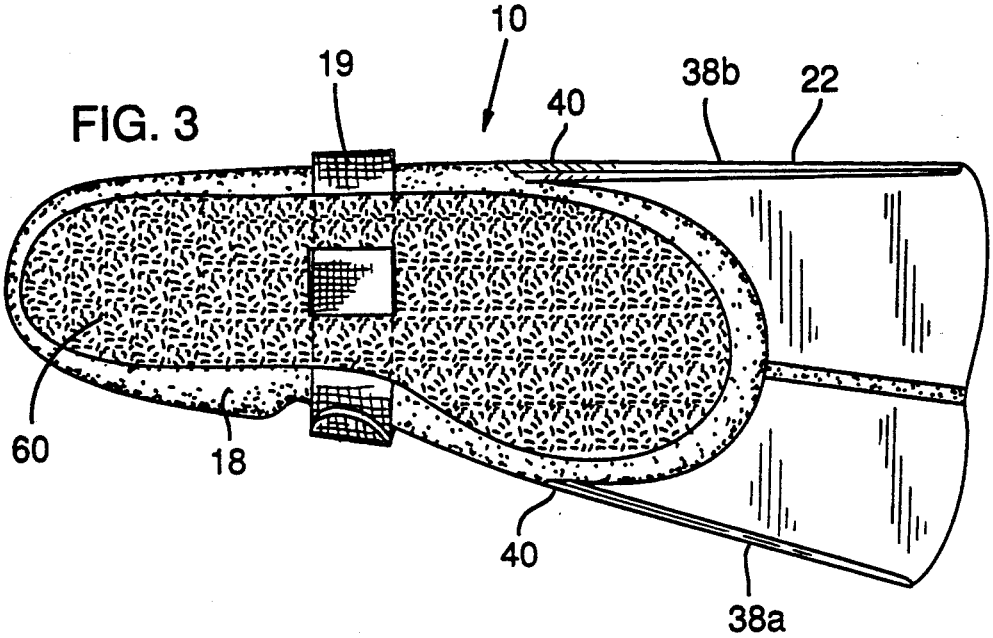
FIG. 3 is a bottom view of the amphibious swim-shoe shown in FIG. 1.

In FIG. 3, the bottom surface 60 of the sole 18 is illustrated. The surface 60 is textured to provide good traction for walking or surfing activities. The tractional advantage of the textured sole surface is also useful for water aerobics, a popular new conditioning sport which requires the participant to stand, jump, and move on and off of a swimming pool floor. The elevated fin, flexible vamp and textured sole employed in the described swim-shoe make the present invention particularly useful for this popular activity.

As shown in the preferred embodiment illustrated in FIG. 4, the unloaded swim-shoe is substantially curved or bowed upward from the heel to the toe, defining an angle A in the range of 20 to 45% from the horizontal. The curvature of the swim-shoe is lessened with insertion of a foot. There are at least two notable benefits to the swim-shoe's curved profile. First, retention of a small amount of curvature when the swim-shoe is worn helps to minimize interference with walking activity due to the fin. Second, curvature of the unloaded swim-shoe is partially a result of the tautness of the stretchable fabric vamp. The tautness of the vamp in the unloaded swim-shoe helps to produce a snug, comfortable feel around the user's foot when the swim-shoe is worn.

There are a number of different ways to produce a swim-shoe in accordance with the present invention. For example, it is possible to first make an entire fabric boot around which the elastomeric base piece is formed and joined. Alternatively, a fabric vamp portion alone can be cut-out and then joined to a base piece which has been independently molded. In either method the same result is accomplished, i.e., a swim-shoe is produced in which the sole and fin components exhibit requisite rigidity without discomforting the upper arch and ankle regions of the foot. By further limiting the dimensions and orientation of the fin as explained above, an exceptionally versatile footwear piece is realized.

It is not intended that the claimed invention be limited to the specific details of the preferred embodiments described above. Numerous other modifications and variations which are consistent with the scope and spirit of the invention as described are also claimed.

I claim:

1. Amphibious footwear comprising:
a stretchable fabric vamp for conforming around the upper arch portion of a user's foot;
an elastomeric base piece including a heel support extending around the back of the user's foot, a fin support member extending over the tops of the user's toes, a sole and a forwardly extending fin, wherein the base piece has an upper boundary circumventing the upper arch portion of the user's foot, the base piece being sufficiently rigid so that the fin substantially maintains its extended form during the user's water kicking activity; and
a joinder line directly attaching the vamp to the upper boundary of the base piece.

2. The footwear of claim 1 wherein the joinder line is circuitous around the user's ankle.

3. The footwear of claim 1 wherein the fin support member has a length and the fin has a length, the length of the fin support member being between 60% and 70% of the length of the fin.

4. The footwear of claim 1 wherein the fin is intermediately elevated and anchored relative to the fin support member for providing fin stability and comfort.

5. The footwear of claim 1 wherein the fabric is isotropically stretchable.

6. The footwear of claim 1 wherein the fin extends beyond the sole by a length which is approximately 20 percent of the total length of the footwear.

7. The footwear of claim 1 wherein the widest width of the fin less than approximately 130% of the widest width of the sole.

8. The footwear of claim 1 wherein the sole and the fin are integral parts of a single unitary piece.

9. The footwear of claim 1 wherein the sole of the base piece has a mid-portion corresponding approximately to the ball of the user's foot, the fin having a distal edge from which two lateral edges taper inward, each lateral edge merging with the mid-portion of the sole.

10. The footwear of claim 1 further comprising:
an adjustable strap fastenable over the vamp for providing support when swimming and being releasable to allow greater comfort for walking.

11. The footwear of claim 9 wherein the fin has at least one thickened support rib positioned between the fin's lateral edges and extending perpendicularly from the fin's distal edge to the fin support member of the base piece.

12. Amphibious footwear comprising:
a stretchable fabric upper member; and
an elastomeric base piece having a sole, a fin support member extending over the tops of the user's toes and a forwardly extending fin intermediately elevated and anchored to the fin support member; wherein the base piece has a circuitous upper edge surrounding the upper arch portion of the user's foot, the upper edge of the base piece being directly attached to the upper member.

13. The footwear of claim 12 wherein the fabric upper is isotropically stretchable.

14. The footwear of claim 12 wherein the fin extends beyond the sole by a length which is approximately 20 percent of the total length of the footwear.

15. The footwear of claim 12 wherein the bottom of the sole in textured for traction.

16. A method for producing amphibious footwear which is versatilely useful for both land and water sports comprising the steps of:
producing an upper vamp member out of fabric which is comfortable around the upper arch region of a user's foot;
producing an elastomeric member including a heel support extending around the user's foot, a fin support member extending over the user's toes, and a forwardly extending fin, wherein the elastomeric member has a circuitous upper edge surrounding the upper arch region of the user's foot; and
directly attaching the upper edge of the elastomeric member to the vamp member.

* * * * *